US007410397B2

(12) United States Patent
Nakamura et al.

(10) Patent No.: US 7,410,397 B2
(45) Date of Patent: Aug. 12, 2008

(54) OUTBOARD MOTOR WITH BRACKET ASSEMBLY

(75) Inventors: Daisuke Nakamura, Shizuoka-ken (JP); Isao Fujii, Shizuoka-ken (JP); Masayuki Arito, Shizuoka-ken (JP); Masayoshi Sawamura, Shizuoka-ken (JP)

(73) Assignee: Yamaha Marine Kabushiki Kaisha, Hamamatsu-Shi, Shizuoka-Ken (JP)

( * ) Notice: Subject to any disclaimer, the term of this patent is extended or adjusted under 35 U.S.C. 154(b) by 0 days.

(21) Appl. No.: 11/125,823

(22) Filed: May 10, 2005

(65) Prior Publication Data

US 2005/0260899 A1 Nov. 24, 2005

(30) Foreign Application Priority Data

May 10, 2004 (JP) ..... 2004-140227
May 10, 2004 (JP) ..... 2004-140228

(51) Int. Cl.
*B63H 5/125* (2006.01)

(52) U.S. Cl. ..... 440/53; 440/63

(58) Field of Classification Search ..... 440/52, 440/53, 58, 59, 60, 62, 63, 61 S, 61 A, 61 B, 440/61 C See application file for complete search history.

(56) References Cited

U.S. PATENT DOCUMENTS 2,911,936 A * 11/1959 Elmer ..... 440/52
3,774,571 A * 11/1973 Shimanckas ..... 440/55
5,194,025 A * 3/1993 Blanchard et al. ..... 440/52

FOREIGN PATENT DOCUMENTS

| | | |
|---|---|---|
| JP | 07-242194 | 9/1995 |
| JP | 10-297591 | 11/1998 |
| JP | 11-245892 | 9/1999 |
| JP | 11-310194 | 11/1999 |

* cited by examiner

*Primary Examiner*—Sherman Basinger
(74) *Attorney, Agent, or Firm*—Knobbe, Martens, Olson & Bear, LLP

(57) ABSTRACT

An outboard motor includes a bracket assembly that has a swivel bracket carrying a drive unit for pivotal movement about a steering axis that extends generally vertically. The swivel bracket has a tubular section that extends generally vertically. The drive unit has a steering member that includes a steering shaft section extending through the tubular section and defining the steering axis. The steering shaft section has top and bottom portions out of the tubular section. The steering shaft section further has an upper portion below the top portion within the tubular section, and a lower portion above the bottom portion within the tubular section. The tubular section has upper, lower and middle bushings. The upper and lower bushings pivotally support the upper and lower portions, respectively. The middle bushing pivotally supports a middle portion of the steering shaft section between the upper and lower portions.

26 Claims, 5 Drawing Sheets

OUTBOARD MOTOR WITH BRACKET ASSEMBLY

PRIORITY INFORMATION

This application is based on and claims priority under 35 U.S.C. § 119 to Japanese Patent Application No. 2004-140227, filed on May 10, 2004, and Japanese Patent Application No. 2004-140228, filed on May 10, 2004, the entire contents of which are hereby expressly incorporated by reference.

BACKGROUND

1. Field of the Art

The present invention generally relates to an outboard motor with a bracket assembly and, more particularly, relates to an outboard motor that has a bracket assembly to mount a drive unit of the outboard motor on an associated watercraft.

2. Description of Related Art

Typically, outboard motors incorporate a bracket assembly to mount a drive unit thereof on a transom of an associated watercraft. The bracket assembly typically includes a swivel bracket carrying the drive unit for pivotal movement about a steering axis that extends generally vertically, and a clamping bracket supporting the swivel bracket and the drive unit for pivotal movement about a tilt axis that extends generally horizontally. The drive unit usually has a propeller in a lower portion thereof to generate thrust that moves the watercraft. Typically, an engine disposed in an upper portion of the drive unit provides power to rotate the propeller through a drive mechanism disposed within the drive unit.

In general, the swivel bracket has a tubular section. The drive unit has a steering shaft extending through the tubular section of the swivel bracket. The steering shaft defines the steering axis. The tubular section has upper and lower bushings to pivotally support the steering shaft. The steering shaft thus can pivot within the tubular section so that the drive unit can move to the port side and to the starboard side about the steering axis. For example, Japanese Patent Publication Nos. JP11-245892A and JP11-310194A disclose such relationships between the tubular section of the swivel bracket and the steering shaft of the drive unit.

The lower portion of the drive unit is submerged under water while the propeller propels the associated watercraft. Under the circumstances, a floating object such as, for example, a piece of driftwood can strike the lower portion of the drive unit, or the drive unit can strike a rock under the water while the watercraft travels in shallow water. Relatively a large impact load is exerted on the bracket assembly in those situations. Even when such an impact load is not exerted, the bracket assembly experiences the thrust loading from the propeller as the propeller propels the associated watercraft.

The impact load or the thrust can generate a relatively large bending moment affecting a portion of the steering shaft between the upper and lower bushings. In order to prevent an outer surface of the steering shaft from contacting with an inner surface of the tubular section by the elastic deformation of the steering shaft caused by the bending moment, an outer diameter of the steering shaft can be slightly smaller than an inner diameter of the tubular section so that those surfaces are spaced apart from each other. Alternatively, both of the tubular section and the steering shaft can be made thicker to have relatively high rigidity or strength against the bending moment. Conventionally, the tubular section and the steering shaft are produced by a low pressure cast method using a shell core.

The space made between the tubular section and the steering shaft, however, can make the tubular section larger unless the steering shaft has a smaller outer diameter that is strong enough to endure the bending moment. Also, if the tubular section and the steering shaft are thicker, the outboard motor is inevitably cumbersome and the weight of the outboard motor inevitably increases.

SUMMARY OF THE INVENTION

A need thus exists for a bracket assembly of an outboard motor that can increase rigidity or strength without being heavier. Another need also exists for the bracket assembly of the outboard motor that can provide an improved configuration of a steering shaft that contribute to making the outboard motor smaller and to decreasing the weight of the outboard motor.

To address one or more of such needs, in accordance with one aspect of the present invention, an outboard motor comprises a drive unit and a bracket assembly adapted to mount the drive unit on an associated watercraft. The bracket assembly includes a swivel bracket carrying the drive unit for pivotal movement about a steering axis that extends generally vertically. The swivel bracket has a tubular section that extends generally vertically. The drive unit has a steering member that includes a steering shaft section. The steering shaft section extends through the tubular section of the swivel bracket and defines the steering axis. The steering shaft section has top and bottom portions that extend beyond at least one or more portions of the tubular section. The top and bottom portions are attached to the drive unit. The steering shaft section further has an upper portion below the top portion within the tubular section, and a lower portion above the bottom portion within the tubular section. The tubular section has upper, lower and middle bushings. The upper bushing pivotally supports the upper portion of the steering shaft section. The lower bushing pivotally supports the lower portion of the steering shaft section. The middle bushing pivotally supports a middle portion of the steering shaft section between the upper and lower portions.

In accordance with another aspect of the present invention, an outboard motor comprises a drive unit, and a bracket assembly adapted to mount the drive unit on an associated watercraft. The bracket assembly includes a swivel bracket carrying the drive unit for pivotal movement about a steering axis that extends generally vertically. The swivel bracket has a tubular section that extends generally vertically. The drive unit has a steering member that includes a steering shaft section. The steering shaft section extends through at least a portion of the tubular section of the swivel bracket and defines the steering axis. The steering shaft section includes an upper portion, a middle portion and a lower portion. The middle portion is positioned between the upper and lower portions. The steering shaft section has an inner surface that is tapered toward the middle portion from the upper or lower portion.

BRIEF DESCRIPTION OF THE DRAWINGS

These and other features, aspects and advantages of the present invention are now described with reference to the drawings of a preferred embodiment, which is intended to illustrate and not to limit the present invention. The drawings comprise six figures in which.

DETAILED DESCRIPTION OF A PREFERRED EMBODIMENT OF THE PRESENT INVENTION

Figure 1:
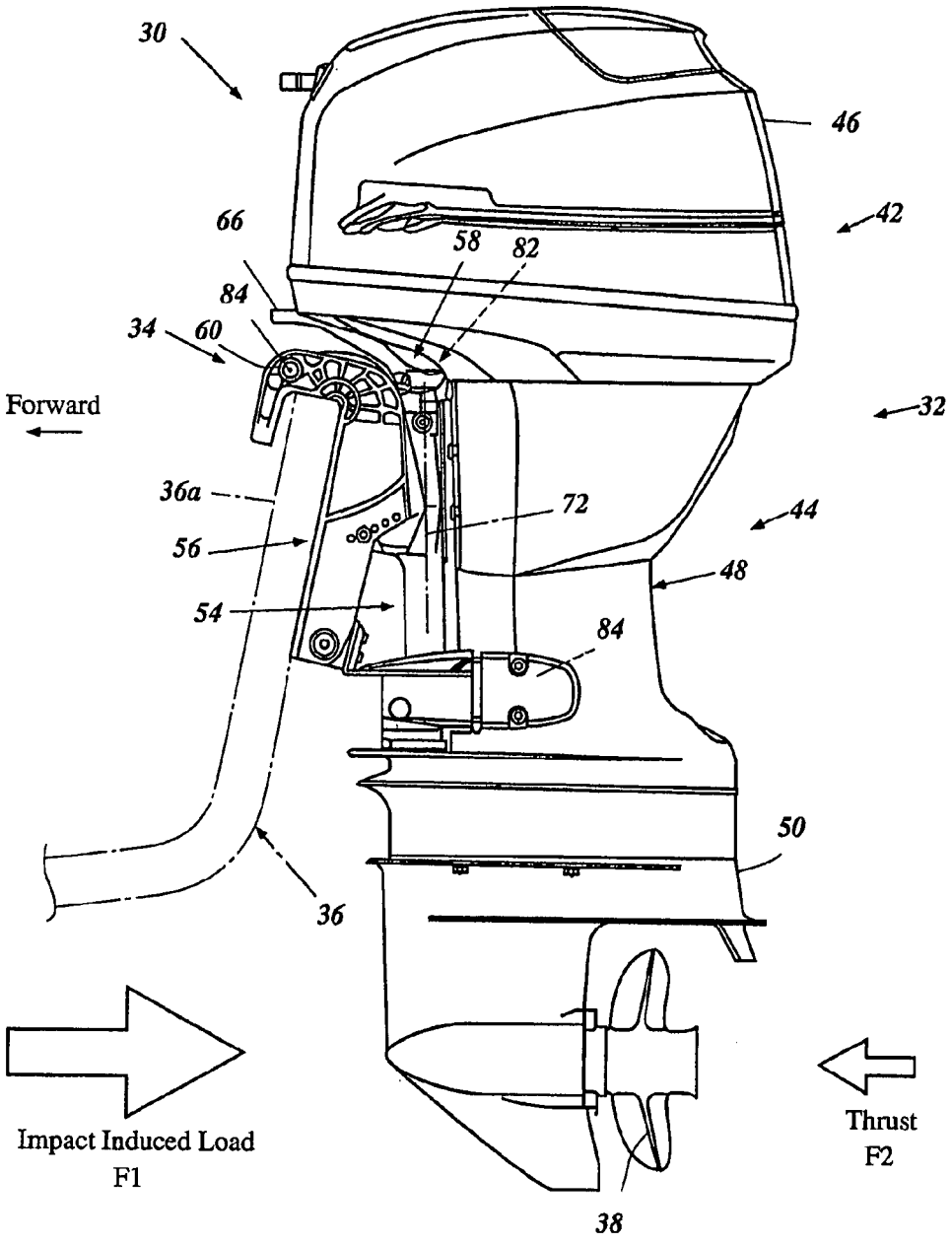
FIG. 1 illustrates a side elevation view of an outboard motor arranged and configured in accordance with certain features, aspects and advantages of the present invention, with a transom of an associated watercraft shown in phantom.

With reference to FIG. 1, an overall configuration of an outboard motor 30 that can be used with various features, aspects and advantages is described.

The outboard motor 30 preferably comprises a drive unit 32 and a bracket assembly 34. The bracket assembly 34 supports the drive unit 32 on a transom 36*a* of an associated watercraft 36 and places a marine propulsion device such as, for example, a propeller 38, in a submerged position with the watercraft resting relative to a surface of a body of water. The drive unit 32 can be tilted up (raised) or tilted down (lowered) relative to the watercraft by a hydraulic tilt and trim adjustment device (not shown) combined with the bracket assembly 34.

As used through this description, the terms "rear," "rearward" and "backward" mean at or to the side where the propeller 38 is located, unless indicated otherwise or otherwise readily apparent from the context used. The terms "forward" and "front" mean at or to the opposite side of the rear side, unless indicated otherwise or otherwise readily apparent from the context used.

Also, as used in this description, the term "horizontally" means that the subject portions, members or components extend generally in parallel to the water surface when the watercraft 36 is substantially stationary with respect to the water surface and when the drive unit 32 is not tilted and is generally placed in the position shown in FIG. 1. The term "vertically" in turn means that portions, members or components extend generally normal to those that extend horizontally.

The drive unit 32 preferably comprises a power head 42 and a housing unit 44. The power head 42 is disposed atop the drive unit 32 and includes an internal combustion engine. In order to protect the engine, the power head 42 also includes a protective cowling assembly 46 that surrounds the engine. The engine generates the power for driving the propeller 38. The engine has a crankshaft preferably extending generally vertically.

The housing unit 44 preferably comprises an upper casing (or driveshaft housing) 48 and a lower casing 50. The illustrated upper and lower casings 48, 50 are made of aluminum alloy. The upper casing 48 depends from the power head 42 through an exhaust guide. The upper casing 48 journals a driveshaft that extends generally vertically within the upper casing 48. A top end of the driveshaft is coupled with a bottom end of the crankshaft of the engine. The lower casing 50 depends from the upper casing 48. The lower casing 50 journals a propulsion shaft that extends generally horizontally within the lower casing 50. The driveshaft and the propulsion shaft are rotatably coupled with each other through a transmission mechanism including a forward-neutral-reverse change device. The propeller 38 is connected to an end of the propulsion shaft. Thus, the power generated by the engine is transmitted to the propeller 38 through the driveshaft and the propulsion shaft. The propeller 38 rotates to produce the thrust that propels the associated watercraft 36.

The power head 42 has an air inlet through which ambient air is introduced into an inner space of the power head 42. The air is further introduced into the engine through an intake system for combustion with fuel which is supplied also to the engine through a proper fuel supply system. The upper and lower casings 48, 50 also define an exhaust passage of exhaust system. Exhaust gases discharged from the engine enter the upper casing 48 through the exhaust guide and are generally discharged to an external location under the water through the upper and lower casings 48, 50.

Figure 2:
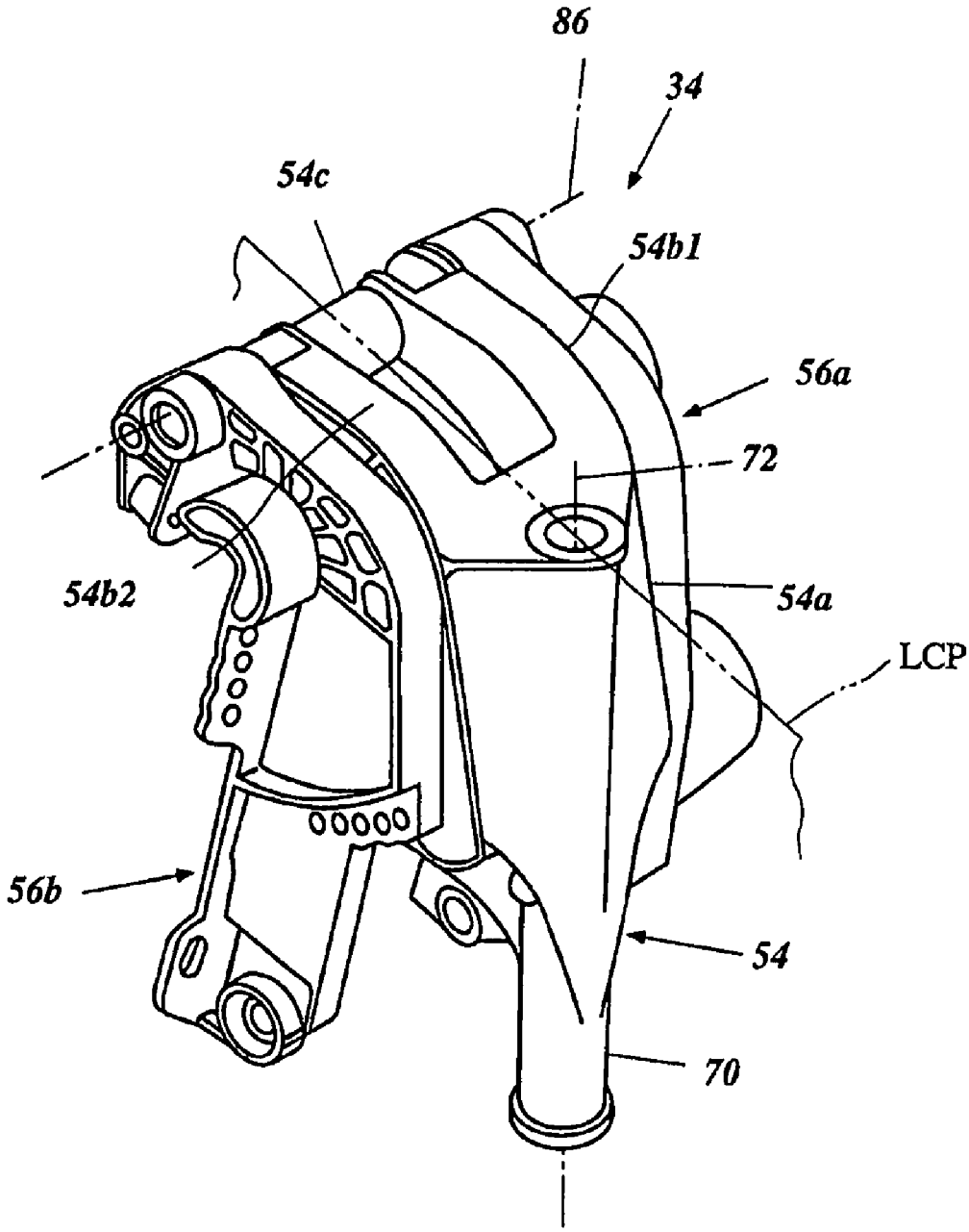
FIG. 2 illustrates a perspective view of a bracket assembly of the outboard motor of FIG. 1.
Figure 3:
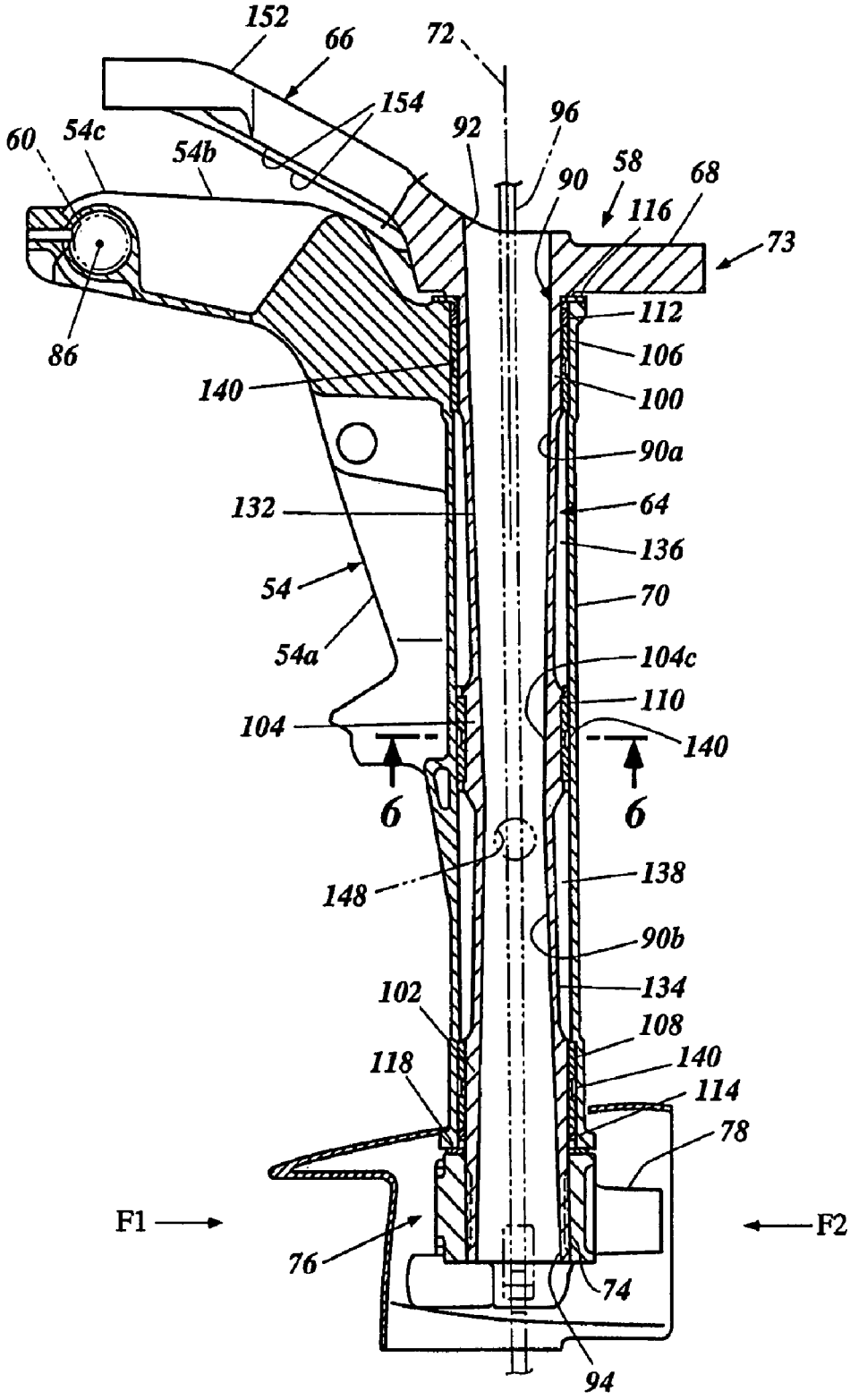
FIG. 3 illustrates a sectional side view taken along the longitudinal center plane of the outboard motor to show a combined state of a swivel bracket of the bracket assembly and a steering member.

With reference to FIGS. 1-3, the bracket assembly 34 and a structure for coupling the bracket assembly 34 with the upper casing 48 are described.

The bracket assembly 34 preferably comprises a swivel bracket 54, a clamping bracket 56, a steering member 58 and a tilt pin 60.

The steering member 58 preferably comprises a steering shaft section 64, a steering lever section 66 and a steering arm section 68 unitarily formed with one other. The illustrated steering shaft section 64 extends generally vertically. The swivel bracket 54 preferably has a tubular section 70 that defines an inner space extending generally vertically. The inner space preferably has a complete circular shape in cross-section (i.e., normal to the steering axis 72). An inner diameter of the tubular section 70 is preferably substantially uniform along its length. In other words, the entire inner surface extends parallel to the steering axis 72. The steering shaft section 64 is fitted into the inner space of the tubular section 70 for pivotal movement about the steering axis 72 of its own.

The steering lever section 66 and the steering arm section 68 are positioned atop the steering member 58 to define a top portion 73 thereof. The steering lever section 66 and the steering arm section 68 extend out of the tubular section 70 of the swivel bracket 54 beyond a top end of the tubular section 70. Preferably, the steering lever section 66 extends generally upward and forward, while the steering arm section 68 extends generally horizontally and rearward. The steering lever section 66 preferably is coupled with a proper steering system of the associated watercraft 36. In the illustrated embodiment, a bottom portion 74 of the steering shaft section 64 extends out of the tubular section 70 of the swivel bracket 54 beyond a bottom end of the tubular section 70. A lower mount housing 76 having a pair of bosses 78 is coupled with the bottom portion 74 through a spline connection. The bosses 78 extend generally rearward.

The steering arm section 68 is preferably affixed to an upper portion of a front surface of the upper casing 48 by an upper mount 82. The lower mount housing 76 is affixed to a lower portion of the front surface of the upper casing 48 by a pair of lower mounts 84 through the bosses 78. In the illustrated embodiment, conventional upper and lower mounts are used. Because each conventional upper or lower mount has a resiliently coupling structure that incorporates a relatively hard elastic material, the upper casing 48 and the steering member 58 are not rigidly coupled but slightly resiliently coupled with each other. The upper and lower mounts 82, 84 and the lower mount housing 76 are covered with proper cover members.

The drive unit 32 thus can be steered with the steering lever section 66 operated. In the illustrated embodiment, the steering axis 72 extends on and along a hypothetical longitudinal center plane LCP (FIG. 2) of the outboard motor 30 that extends vertically and fore to aft. In other words, the longitudinal center plane LCP includes the steering axis 72.

The illustrated swivel bracket 54 has a vertical portion 54*a* that transversely extends generally on both sides of the tubular section 64. A top end of the vertical portion 54*a* is bifurcated to form a pair of horizontal portions 54*b*1, 54*b*2. The horizontal portions 54*b*1, 54*b*2 preferably extend parallel to each other and also parallel to the longitudinal center plane LCP. Respective forward ends of the horizontal portions 54*b*1, 54*b*2 are connected with each other to form a front portion 54*c*. The front portion 54*c* preferably is tubular and extends normal to the longitudinal center plane LCP.

The clamping bracket 56 comprises a pair of bracket arms 56*a*, 56*b* that are transversely spaced apart from each other and can be affixed to the watercraft transom 36*a*. Each bracket arm 56*a*, 56*b* generally has a profile similar to the swivel bracket 54 except for the tubular section 70. The tilt pin 60 extends generally horizontally and completes a hinge coupling between the swivel bracket 54 and the clamping bracket 56, i.e., bracket arms 56*a*, 56*b*. The tilt pin 60 extends through the bracket arms 56*a*, 56*b* and the front portion 54*c* of the swivel bracket 54 such that the clamping bracket 56 supports the swivel bracket 54 for pivotal movement about a tilt axis 86 defined by the tilt pin 60. The tilt axis 86 extends normal to the longitudinal center plane LCP. Because the drive unit 32 is coupled with the swivel bracket 54, both the swivel bracket 54 and the drive unit 32 can be tilted together about the tilt axis 86 relative to the clamping bracket 56.

Preferably, the swivel bracket 54 and the clamping bracket 56 are made of aluminum alloy and are produced in a vacuum die-casting process. The swivel bracket 54 and the clamping bracket 56 are similar to those described in the co-pending application, Ser. No. 11/124,606, filed May 6, 2005 and published as U.S. Pat. Pub. No. 2005/0250394, and entitled "OUTBOARD MOTOR WITH BRACKET ASSEMBLY," which is hereby incorporated by reference.

The hydraulic tilt and trim adjustment device is preferably provided between the swivel bracket 54 and the clamping bracket 56 to tilt (raise or lower) the swivel bracket 54 together with the drive unit 32 relative to the clamping bracket 56. In the illustrated embodiment, a conventional hydraulic tilt and trim adjustment device is used. The tilt and trim adjustment device can have a conventional shock absorbing mechanism to absorb the shock generated when a floating object strikes the drive unit 32 or the drive unit 32 strikes a rock or the like.

With reference to FIGS. 3-6, the steering member 58, the tubular section 70 of the swivel bracket 54, and the structure for coupling the steering member 58 and the tubular section 70 with each other are described in greater detail below.

The steering shaft section 64 of the steering member 58 is tubular. That is, an inner space 90 extends generally vertically through the steering shaft section 64. The top portion 73 has a top opening 92, while the bottom portion 74 has a bottom opening 94. A shift rod 96 for a transmission mechanism preferably extends through the inner space 90.

Preferably, the steering member 58 is made of aluminum alloy and is produced in the vacuum die-casting process. In the illustrated embodiment, first and second dies are placed to define a cavity therebetween. Preferably, one of the first and second dies is a fixed die and the other one is a movable die so that the cavity is adjustably created. Two tapered dies are additionally used for forming the inner space 90. Molten aluminum alloy is introduced into the cavity under a negative pressure. The dies are removed after the aluminum alloy has become hard. The aluminum alloy in the cavities forms the steering member. The vacuum die-casting process will be described in greater detail later.

The steering shaft section 64 has an upper portion 100 just below the top portion 73 and a lower portion 102 just above the bottom portion 94. Both of the upper and lower portions 100, 102 are positioned within the tubular section 70 of the swivel bracket 54. The steering shaft section 64 preferably has at least one middle portion 104 between the upper and lower portions 100, 102. The respective upper, lower and middle portions 100, 102, 104 preferably have a complete circular shape in cross-section (as taken in a direction normal to the steering axis 72). In the illustrated embodiment, the middle portion 104 is generally equally spaced apart from the upper and lower portions 100, 102 in the vertical direction. Alternatively, the distances can differ from each other.

The upper, lower and middle portions 100, 102, 104 preferably have an outer diameter that is slightly smaller than an inner diameter of the tubular section 70. Upper, lower and middle bushings 106, 108, 110 are preferably disposed between the upper, lower and middle portions 100, 102, 104 and corresponding portions of the tubular section 70, respectively. In other words, the upper, lower and middle bushings 106, 108, 110 journal the upper, lower and middle portions 100, 102, 104 of the steering shaft section 64, respectively, so that the steering member 58 is pivotal about the steering axis 72 relative to the bushings 106, 108, 110. The upper, lower and middle bushings 106, 108, 110 are preferably made of plastic (synthetic resin) or metal. The bushings 106, 108, 110 preferably each have a groove 140 extending generally horizontally around the steering axis 72.

Figure 6:
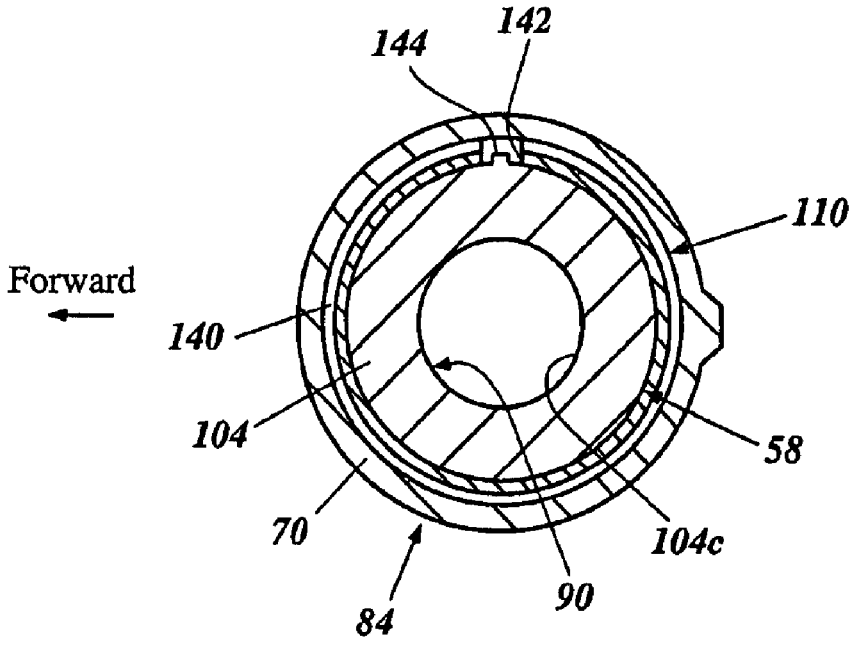
FIG. 6 illustrates a cross-sectional view of the bracket arm taken along the line 6-6 of FIG. 3.

Each bushing 106, 108, 110 preferably has a slit extending generally vertically. FIG. 6 shows a slit 142 of the middle bushing 110. Because of this slit 142, the middle bushing 110 is generally configured as a substantially closed letter C. The other bushings 106, 108 are also configured similarly. The bushings 106, 108, 110 are somewhat elastically deformable circumferentially because of the respective slits 142.

A seal member 112 is preferably inserted into a gap made above the upper bushing 106. Another seal member 114 is preferably inserted into another gap made below the lower bushing 108. In addition, a washer 116 is preferably placed between a top surface of the tubular section 70 and a bottom surface of the top portion 73 of the steering member 58. Another washer 118 is preferably placed between a bottom surface of the tubular section 70 and a top surface of the lower mount housing 76.

The upper and lower portions 100, 102 preferably have the same thickness as each other, while the middle portion 104 is thicker than the upper and lower portions 100, 102. In other words, an inner diameter of the middle portion 104 is smaller than an inner diameter of the respective upper and lower portions 100, 102. In the illustrated embodiment, a center 104C of the middle portion 104 in the vertical direction has the narrowest inner diameter. The center 104C of the middle portion 104 is generally positioned in the center of the inner space 90 because the middle portion 104 is formed at the center of the steering shaft section 64 in this embodiment. The illustrated center 104C is positioned on the cross-section line 6-6 shown in FIG. 3. The nearer the portion of the steering member 58 approaches the top end of the top portion 73 or approaches the bottom end of the bottom portion 74, the larger the inner diameter of the steering member 58 becomes. The inner space 90 thus is divided into an upper half 90*a*, which tapers (e.g., narrow) toward the center 104C of the middle portion 104 from the top end of the top portion 73, and a lower half 90*b* which tapers toward the center 104C of the middle portion 104 from the bottom end of the bottom portion 74. In other words, the steering shaft section 64 has an inner surface that is tapered toward the middle portion 104 from the upper and lower portions 100, 102.

Alternatively, the entire middle portion 104 can have the same inner diameter. In this alternative, the inner space 90 is tapered toward a top end of the middle portion 104 from the top end of the top portion 73, and also is tapered toward a bottom end of the middle portion 104 from the bottom end of the bottom portion 74. An area of the middle portion 104 in the alternative is not tapered but is generally straight. In other alternatives, the inner space 90 is not entirely tapered toward the middle portion 104. For example, an upper half of the inner space 90 can be tapered and a lower half thereof can be straight, and vice-versa. Further, even both of the upper and lower halves can be straight in some alternative constructions.

Figure 4:
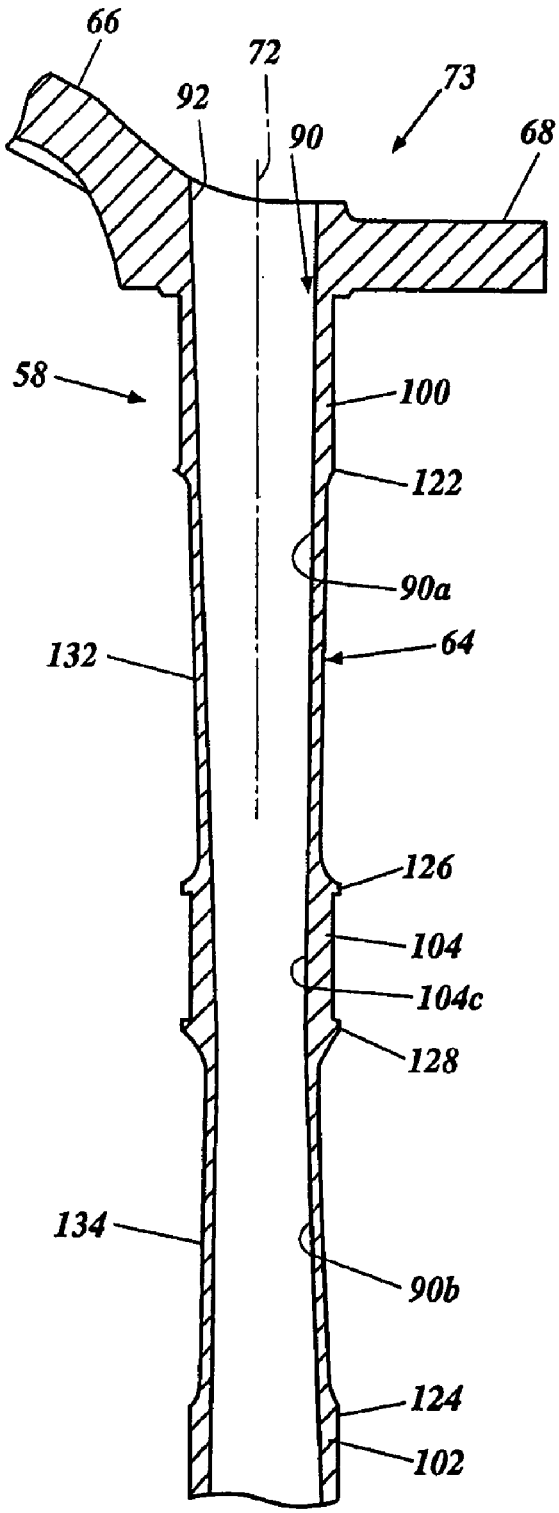
FIG. 4 illustrates a cross-sectional side view of the steering member taken along the longitudinal center plane.

As best shown in FIG. 4, the upper portion 100 preferably has a circular projection or collar 122 at its bottom end. The circular projection 122 gives a lower positioning reference for the upper bushing 106. Also, the lower portion 102 preferably has a circular projection or collar 124 at its top end. The circular projection 124 gives an upper positioning reference for the lower bushing 108. Further, the middle portion 104 preferably has circular flanges or collars 126, 128 at its top and bottom ends. The circular flanges 126, 128 give upper and lower positioning references for the middle bushing 110. Thus, the upper, lower and middle bushings 106, 108, 110 are inhibited from moving axially by the circular projections 122, 124 and the circular flanges 126, 128, respectively.

All the bushings 106, 108, 110 can be furnished from the bottom end of the steering shaft section 64. Then, the upper and middle bushings 106, 110 are further moved upward toward the upper and middle portions 100, 104, respectively. Because the steering shaft section 64 has the circular projection 124 and the circular flanges 126, 128, the upper and middle bushings 106, 110 need to be deformed to pass the projection 124 and the flanges 126, 128. The lower bushing 108 does not need to pass any projections or flanges. Thus, the lower bushing 108 can be simply furnished onto the lower portion 102. Afterwards, the steering member 58 with the bushings 106, 108, 110 is fitted into the tubular section 70 through the top opening 92 to complete the pivotal connection of the steering shaft section 64 with the tubular section 70.

As shown in FIG. 6, the steering shaft section 64 preferably has a projected rib or wall 144 extending generally vertically on a lateral side surface thereof (preferably on the starboard side). More specifically, the rib 144 extends generally parallel to the steering axis 72, and a hypothetical line generally intersecting the steering axis 72 and extending generally parallel to the tilt axis 86 intersects the rib 144. In other words, the rib 144 extends right beside the steering axis 72. The projected rib 144 engages with the respective slits 142 of the upper, lower and middle bushings 106, 108, 110 to prevent the respective bushings 106, 108, 110 from rotating. The illustrated rib 144 is unitarily formed with the steering member 58. Alternatively, multiple projections, which are individually formed on the steering shaft section 64 corresponding to the respective bushings 106, 108, 110, can replace the projected rib 144.

In the illustrated embodiment, the projected rib 144 of each bushing 106, 108, 110 has a height that generally reaches a bottom of the groove 140. The height is measured from the side surface of steering shaft section 64. Also, the circular projections 122, 124 and the circular flanges 126, 128 generally have the same height as the projected rib 144.

In the illustrated preferred embodiment, a portion 132 of the steering shaft section 64 between the circular projection 122 and the circular flange 126 has an outer surface that preferably extends parallel to the inner surface of the upper half 90*a* of the inner space 90. Also, another portion 134 of the steering shaft section 64 between the circular projection 124 and the circular flange 128 has an outer surface that preferably extends parallel to the inner surface of the lower half 90*b* of the inner space 90. In other words, the steering shaft section 64 has an outer surface that is tapered toward the middle portion 104 from the upper and lower portions 100, 102. Accordingly, the respective tapered portions 132, 134 generally have a constant thickness. In the illustrated embodiment, the thickness of the tapered portion 132 is the same as the thickness of the tapered portion 134. In other embodiments, however, the thickness can vary along the length of the steering shaft section 64.

The tapered portions 132, 134, however, can have a different thickness from one another. In addition, one of the tapered portions 132, 134 can be straight, or even both of the tapered portions 132, 134 can be straight in some alternatives.

Because of this configuration of the steering member 58, the first and second dies used in the vacuum die-casting process are opposed to each other relative to a hypothetical vertical plane that includes the steering axis 72 (once assembled) and extends normal to the longitudinal center plane LCP. That is, the vertical plane makes a parting line of the first and second dies that extends transversely and includes the steering axis 72. If the first die is positioned in front of the second die and the first die is the movable die, the first die is removed forward relative to the second die, which is the fixed die. In addition, third and fourth dies, each one of which has a tapered shape, are placed between the first and second dies. The third and fourth dies are movable along the steering axis 72. Respective most narrowed ends of the third and fourth dies are opposed to each other relative to a hypothetical horizontal plane including the center (or center line) 104C of the middle portion 104. The horizontal plane makes a parting line of the third and fourth dies. Additionally, the horizontal plane preferably corresponds to the line 6-6 of FIG. 3.

Because those dies are tapered, the third die is movable upward along the steering axis 72 from its set position. Also, the fourth die is movable downward along the steering axis 72 from its set position. This is further because the steering shaft section 64 has the tapered shape. The inner space 90 of the steering shaft section 64 thus can be formed without using any shell core. Generally, shell cores can make it difficult to apply the vacuum die-casting method. Because no sand core is required in the illustrated embodiment, the vacuum die-casting method is easily applicable. Thus, the steering member 58 can be as thin as possible using the vacuum die-casting method except for portions that needs to be reinforced. Accordingly, such a thin construction of the steering member contributes to making the outboard motor smaller and to decreasing the weight of the outboard motor. It should be noted, however, that the steering member can be produced by other methods such as, for example, a low pressure die-casting method in some aspects of the present invention.

In some variations, the outer surface of the steering shaft section 64 can be entirely straight along the inner surface of the tubular section 70. However, the outer surface of the steering shaft section 64 is tapered along the inner surface thereof in the illustrated embodiment. The thickness of the steering shaft section 64 thus is generally constant. The constant thickness can further contribute to reducing the weight of the steering member 58.

As discussed above, the lower casing 50 is submerged under water while the propeller 38 propels the associated watercraft 36. Under the circumstances, a floating object such as, for example, a piece of driftwood can strike the lower casing 50, or the lower casing 50 can strike a rock under the water while the watercraft 36 travels through shallow water. As schematically illustrated in FIGS. 1 and 3, a relatively large impact load F1 can be exerted on the bracket assembly 34 in those situations. Additionally, even when such an impact load F1 is not experienced, the bracket assembly 34 always counteracts the thrust loading F2 from the propeller 38.

The impact load F1 or the thrust load F2 can generate a relatively large bending moment affecting the steering shaft section 64. However, the three or more bushings (e.g., the upper, lower and middle bushings 106, 108, 110 in the illustrated embodiment), support the steering shaft section 64 against the bending moment. Particularly, the middle bushing 110 effectively supports the middle portion 104 of the steering shaft section 64. The bracket assembly 34 thus can obtain sufficient rigidity or strength without being cumbersome or heavier in comparison with a structure in which the tubular section and the steering shaft section have large thickness.

The inner space of the tubular section 64 is principally occupied by the steering shaft section 64. As shown in FIG. 3, however, upper and lower spaces 136, 138 remain above and below the middle portion 104 due to the tapered portions 132, 134 of the steering shaft section 64.

In order to lubricate the upper, lower and middle bushings 106, 108, 110, lubricant is preferably supplied to those bushings 106, 108, 110. In the illustrated embodiment, grease is supplied as a lubricant. As shown in FIG. 3, a lateral side surface of the tubular section 70 on the port side preferably has an opening or lubricant inlet 148 for introducing grease. The opening 148 in the illustrated embodiment is positioned at a portion of the side surface where a hypothetical line generally intersecting the steering axis 72 at right angles and extending generally parallel to the tilt axis 86 passes through. In other words, the opening 148 is generally located right beside the steering axis 72. In addition, the opening 148 is preferably positioned in an area of the lower space 138. A grease nipple is preferably attached to the opening 148. Other locations for the opening 148 are also possible, as well as the use of a plurality of such openings.

The side surface of the tubular section 70 is less affected by the impact load F1 or the thrust F2 than a front or rear surface. The rigidity or strength of the tubular section 70 thus is not deteriorated by the opening 148. More specifically, the impact load F1 or the thrust load F2 may cause a compressive force by the bending moment. Although the compressive force is exerted on the tubular section 70, the opening 148 is generally neutrally positioned relative to the compressive force. The presence of the opening 148 in the tubular section 70 thus does not meaningfully reduce the rigidity or strength of the tubular section 70 under such loadings.

The grease is introduced into the lower space 138 through the grease nipple of the opening 148. The grease initially moves to the lower and middle bushings 108, 110 to lubricate those bushings 108, 110. The grease also moves to the upper space 136 through the slit 142 of the middle bushing 110 and further to the upper bushing 106 to lubricate the upper bushing 106 also. That is, the slit 142 of the middle bushing 110 works as a grease passage in this embodiment. The seal members 112, 114 prevent the grease from leaking beyond the ends of the tubular section 70.

Because the middle bushing 110 has the slit 142, the middle bushing 110 does not hamper the migration of grease into the upper space 136 from the lower space 138. This is advantageous because another opening is not necessary in an area of the upper space 136. The slit 142 is primarily provided for the purpose of middle bushing's easy deformation. This is also advantageous because an additional slit or the like as the grease passage is not necessary.

The middle bushing 110 can have another construction that is only for grease flow into the upper space. Unless the construction is required to adapt for the easy deformation of the bushing 110, a groove or aperture, which is formed on or in the bushing 110 to have the upper and lower spaces 136, 138 communicate with each other, can replace the slit. If the middle bushing 110 has the groove that faces the inner surface of the tubular section 70, the middle bushing 110 and the tubular section 70 together define a grease passage. If the middle bushing 110 has the groove that faces the outer surface of the steering shaft section 64, the middle bushing 110 and the steering shaft section 64 together define a grease passage. Also, if the bushing 110 has the aperture, the bushing 110 simply defines the passage by itself.

In general, the slits 142 may reduce the rigidity or strength of the bushings 106, 108, 110. The slits 142, however, are inevitably positioned generally right beside the steering axis 72 because the projected rib 144 of the steering shaft section 64 extends generally right beside the steering axis 72 in the illustrated embodiment. The slits 142 thus are less affected by the impact load F1 or the thrust load F2. More specifically, the impact load F1 or the thrust load F2 may cause a compressive force by the bending moment as discussed above. Although the compressive force is exerted on the bushings 106, 108, 110, the slits 142 are generally neutrally positioned relative to the compressive force similarly to the opening 148. The rigidity or strength of the bushings 106, 108, 110 thus are not meaningfully diminished even under an impact or thrust loadings. This arrangement is particularly useful when the bushings 106, 108, 110 are made of plastic (synthetic resin).

Figure 5:
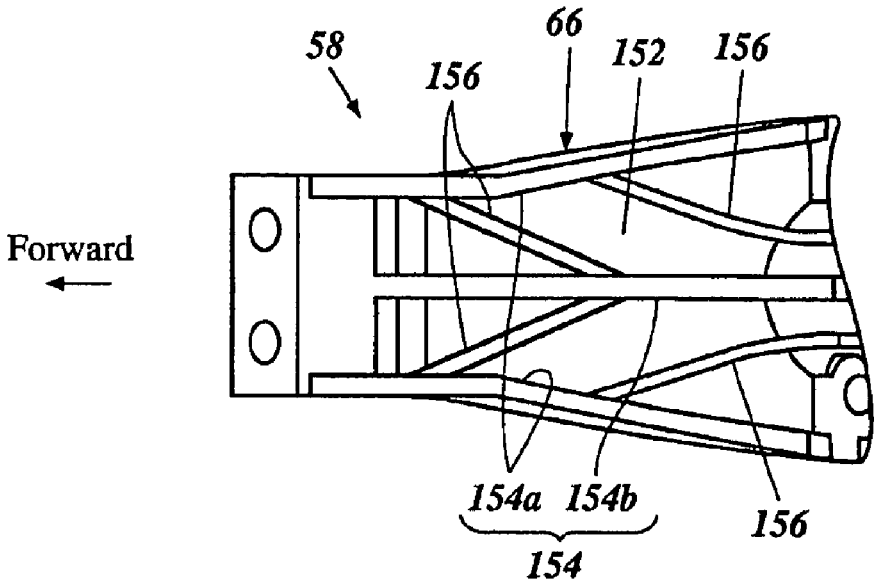
FIG. 5 illustrates a partial bottom plan view of a steering lever section of the steering member.

With reference to FIG. 5, the steering lever section 66 is basically formed with a web 152 in the illustrated embodiment. The web 152 is relatively thin (for example, approximately less than 1.5 mm) and generally has a sheet-like shape. The illustrated web 152 is unitarily formed with the remainder sections of the steering member 58. The web 152 extends generally parallel to the tilt axis 86 and has an area extending transversely. The steering lever section 66 is preferably reinforced by flanges 154 and multiple cross ribs 156. The respective flanges 154 and ribs 156 generally have the same thickness as the web 152. The flanges 154 preferably comprise a pair of side flanges 154*a* and a center flange 154*b*. Preferably, each side flange 154*a* extends fore to aft along a side end of the web 152 and extends vertically downward from a bottom surface of the web 152. The center flange 154*b* preferably extends parallel to the side flanges 154*a* in the center of the bottom surface of the steering lever section 66. The ribs 156 are preferably obliquely extend relative to the flanges 154. Some of the ribs 156 connect the flanges 154 with each other. Alternatively, the ribs 156 can extend normal to the flanges 154.

As thus constructed, the web 152 can not only sufficiently bear both of the right and left steering loads but also bear a bending moment that is exerted on the steering lever section 66 in the vertical direction, although the web 152 itself is relatively thin.

The steering lever section 66 is preferably formed in the vacuum die-casting process together with the other sections of the steering member 58. Preferably, a fifth die is used to form the flanges 154 and the ribs 156. That is, the fifth die is positioned and separately above the first die (if the first die is positioned in front of the second die and the first die is movable die). In view of FIG. 3, the fifth die is removed downward in the vertical direction after the first die has been removed forward in the horizontal direction.

As discussed above, the steering member 58 is resiliently affixed to the upper casing 48 through the upper and lower mounts 82, 84. The thrust F2 thus can slightly rotate the steering shaft section 64 clockwise in the view of FIG. 3 with the middle portion 104 being a fulcrum. That is, the lower portion 102 may move forward, while the upper portion 100 may move backward. A concern can arise if the movement of the steering shaft section 64 hampers the shift rod 96 or not. However, the middle portion 104, which is most narrowed, is the fulcrum and does not move either forward or backward relative to the shift rod 72. Even under such a condition, the movement of the steering shaft section 64 does not impact the shift rod 96. In addition, the shift rod 96 itself can swing back and forth when the transmission mechanism is operated. The center of the swing is generally located adjacent to the middle portion 104. Thus, the movement of the steering shaft section 64 is generally consistent with the movement of the shift rod 96. Accordingly, the steering shaft section 64 has no affect on the operation of the shift rod 96.

The vacuum die-casting method is most useful to produce the steering member, the swivel bracket and the clamping bracket described above. However, other methods such as, for example, a conventional low pressure casting are still applicable.

While the preferred embodiment utilizes cylindrical sleeves as the bushings to provide a bearing surface for the steering shaft section, other types of bearing surfaces can also be used in other application. Accordingly, the term "bushing" should be broadly construed to include any device or mechanism (including a ball bush) that provides a bearing surface to journal the corresponding portion of the steering shaft section. In addition, in some applications, at least one of the bushings can be unitarily formed with the tubular section, and in other applications two or more of the bushings can be of differing types.

Although this invention has been disclosed in the context of a certain preferred embodiment, it will be understood by those skilled in the art that the present invention extends beyond the specifically disclosed embodiment to other alternative embodiments and/or uses of the invention and obvious modifications and equivalents thereof. It is also contemplated that various combinations or sub-combinations of the specific features and aspects of the embodiments may be made and still fall within the scope of the invention. It should be understood that various features and aspects of the disclosed embodiment can be combined with or substituted for one another in order to form varying modes of the disclosed invention. Thus, it is intended that the scope of the present invention herein disclosed should not be limited by the particular disclosed embodiment described above, but should be determined only by a fair reading of the claims.

What is claimed is:

1. An outboard motor comprising a drive unit, and a bracket assembly adapted to mount the drive unit on an associated watercraft, the bracket assembly including a swivel bracket carrying the drive unit for pivotal movement about a steering axis that extends generally vertically, the swivel bracket having a tubular section that extends generally vertically, the drive unit having a steering member that includes a steering shaft section, the steering shaft section extending through the tubular section of the swivel bracket and defining the steering axis, the steering shaft section having top and bottom portions that exposed beyond at least a portion of the tubular section, the top and bottom portions being attached to the drive unit, the steering shaft section further having an upper portion below the top portion within the tubular section, and a lower portion above the bottom portion within the tubular section, the tubular section including upper, lower and middle bushings, the upper bushing pivotally supporting the upper portion of the steering shaft section, the lower bushing pivotally supporting the lower portion of the steering shaft section, and the middle bushing pivotally supporting a middle portion of the steering shaft section between the upper and lower portions without any locking mechanism or clutch disposed between the tubular section and the steering shaft and between the upper and lower bushings.

2. The outboard motor as set forth in claim 1, wherein the tubular section of the swivel bracket and the steering shaft section of the steering member defines an upper space therebetween above the middle bushing, the tubular section of the swivel bracket and the steering shaft section of the steering member defines a lower space therebetween below the middle bushing, and at least the middle bushing defining a passage through which the upper and lower spaces communicates with each other.

3. The outboard motor as set forth in claim 2, wherein the middle bushing and either the tubular section or the steering shaft section together define the passage.

4. The outboard motor as set forth in claim 2, wherein the middle bushing, the tubular section and the steering shaft section together define the passage.

5. The outboard motor as set forth in claim 2, wherein the middle bushing has a slit that defines the passage.

6. The outboard motor as set forth in claim 2, wherein the tubular section of the swivel bracket having a lubricant inlet configured to permit lubricant to be supplied to at least one of the upper and lower spaces.

7. The outboard motor as set forth in claim 6, wherein the lubricant inlet is generally formed on a lateral side portion of the tubular section.

8. The outboard motor as set forth in claim 7, wherein the bracket assembly further includes a clamping bracket supporting the swivel bracket and the drive unit for pivotal movement about a tilt axis extending generally horizontally, and a hypothetical line generally intersecting the steering axis at right angles and generally extending parallel to the tilt axis passes through the lateral side portion of the tubular section.

9. The outboard motor as set forth in claim 1, wherein the steering shaft section has an inner surface that is tapered toward the middle portion from the upper or lower portion.

10. The outboard motor as set forth in claim 9, wherein the steering shaft section has an outer surface that is tapered toward the middle portion from the upper or lower portion.

11. The outboard motor as set forth in claim 9, wherein the inner surface is tapered toward the middle portion from both the upper and lower portions over a substantial portion of its length.

12. The outboard motor as set forth in claim 1, wherein the bracket assembly further includes a clamping bracket supporting the swivel bracket and the drive unit for pivotal movement about a tilt axis extending generally horizontally, the steering member further includes a steering lever section that extends generally forward from the top portion of the steering shaft section, and the steering lever section comprises a web portion extending generally parallel to the tilt axis and at least one portion extending generally normal to the web portion.

13. The outboard motor as set forth in claim 1, wherein at least one of the bushings is configured to be inserted into the tubular section.

14. The outboard motor as set forth in claim 13, wherein the bushings are sealed within the tubular section.

15. An outboard motor comprising a drive unit, and a bracket assembly adapted to mount the drive unit on an associated watercraft, the bracket assembly including a swivel bracket carrying the drive unit for pivotal movement about a steering axis that extends generally vertically, the swivel bracket having a tubular section that extends generally vertically, the drive unit having a steering member that includes a steering shaft section, the steering shaft section extending through the tubular section of the swivel bracket and defining the steering axis, the steering shaft section including an upper portion, a middle portion and a lower portion, the middle portion being positioned between the upper and lower portions, and the steering shaft section having at least a first inner surface extending from the upper portion to the middle portion and at least a second inner surface extending from the lower portion to the middle portion, each of the first and second inner surfaces being tapered over approximately half of its length.

16. The outboard motor as set forth in claim 15, wherein the steering shaft section has an outer surface that is tapered toward the middle portion from the upper or lower portion.

17. The outboard motor as set forth in claim 16, wherein a thickness of the steering shaft section in a tapered area where the inner and outer surfaces are tapered toward the middle portion is generally constant.

18. The outboard motor as set forth in claim 15, wherein the steering member is produced in a vacuum die-casting process.

19. An outboard motor comprising a drive unit, and a bracket assembly adapted to mount the drive unit on an associated watercraft, the bracket assembly including a swivel bracket carrying the drive unit for pivotal movement about a steering axis that extends generally vertically, the swivel bracket having a tubular section that extends generally vertically, the drive unit having a steering member that includes a steering shaft section, the steering shaft section extending through the tubular section of the swivel bracket and defining the steering axis, the steering shaft section including an upper portion, a middle portion and a lower portion, the middle portion being positioned between the upper and lower portions, and the steering shaft section having at least a first inner surface extending from the upper portion to the middle portion and at least a second inner surface extending from the lower portion to the middle portion, at least one of the first and second inner surfaces being tapered over at least half of its length, wherein the tubular section of the swivel bracket has upper, lower and middle bushings, the upper bushing pivotally supports the upper portion of the steering shaft section, the lower bushing pivotally supports the lower portion of the steering shaft section, and the middle bushing pivotally supports the middle portion of the steering shaft section.

20. An outboard motor comprising a drive unit, and a bracket assembly adapted to mount the drive unit on an associated watercraft, the bracket assembly including a swivel bracket carrying the drive unit for pivotal movement about a steering axis that extends generally vertically, the swivel bracket having a tubular section that extends generally vertically, the drive unit having a steering member that includes a steering shaft section, the steering shaft section extending through the tubular section of the swivel bracket and defining the steering axis, the steering shaft section including an upper portion, a middle portion and a lower portion, the middle portion being positioned between the upper and lower portions, and the steering shaft section having at least a first inner surface extending from the upper portion to the middle portion and at least a second inner surface extending from the lower portion to the middle portion, at least one of the first and second inner surfaces being tapered over at least half of its length, wherein the bracket assembly further includes a clamping bracket supporting the swivel bracket and the drive unit for pivotal movement about a tilt axis extending generally horizontally, the steering shaft section further includes a top portion above the upper portion, the steering member further includes a steering lever section that extends generally forward from the top portion of the steering shaft section, the steering lever section comprises a web portion extending generally parallel to the tilt axis and at least one reinforcing portion extending generally normal to the web portion.

21. An outboard motor comprising a drive unit, and a bracket assembly adapted to mount the drive unit on an associated watercraft, the bracket assembly including a swivel bracket carrying the drive unit for pivotal movement about a steering axis that extends generally vertically, the swivel bracket having a tubular section that extends generally vertically, the drive unit having a steering member that includes a steering shaft section, the steering shaft section extending through the tubular section of the swivel bracket and defining the steering axis, the steering shaft section having top and bottom portions that exposed beyond at least a portion of the tubular section, the top and bottom portions being attached to the drive unit, the steering shaft section further having an upper portion below the top portion within the tubular section, and a lower portion above the bottom portion within the tubular section, the tubular section including upper, lower and middle bushings, the upper bushing pivotally supporting the upper portion of the steering shaft section, the lower bushing pivotally supporting the lower portion of the steering shaft section, and the middle bushing contacting and pivotally supporting a middle portion of the steering shaft section between the upper and lower portions, without any clutch disposed between the tubular section and the steering shaft and between the upper and lower bushings.

22. The outboard motor as set forth in claim 21, wherein the steering shaft section has an inner surface, the inner surface tapering from the upper portion toward the middle portion over a majority of a distance between the upper portion and the middle portion, and the inner surface tapering from the lower portion toward the middle portion over a majority of a distance between the lower portion and the middle portion.

23. An outboard motor comprising a drive unit, and a bracket assembly adapted to mount the drive unit on an associated watercraft, the bracket assembly including a swivel bracket carrying the drive unit for pivotal movement about a steering axis that extends generally vertically, the swivel bracket having a tubular section that extends generally vertically, the drive unit having a steering member that includes a steering shaft section, the steering shaft section extending through the tubular section of the swivel bracket and defining the steering axis, the steering shaft section having top and bottom portions that exposed beyond at least a portion of the tubular section, the top and bottom portions being attached to the drive unit, the steering shaft section further having an upper portion below the top portion within the tubular section, and a lower portion above the bottom portion within the tubular section, the tubular section including upper, lower and middle bushings, the upper bushing pivotally supporting the upper portion of the steering shaft section, the lower bushing pivotally supporting the lower portion of the steering shaft section, and the middle bushing pivotally supporting a generally circular middle portion of the steering shaft section between the upper and lower portions, without any clutch disposed between the tubular section and the steering shaft and between the upper and lower bushings.

24. The outboard motor as set forth in claim 23, wherein the steering shaft section has an inner surface, the inner surface tapering from the upper bushing toward the middle bushing over a majority of a distance between the upper bushing and the middle bushing, and the inner surface tapering from the lower bushing toward the middle bushing over a majority of a distance between the lower bushing and the middle bushing.

25. An outboard motor comprising a drive unit, and a bracket assembly adapted to mount the drive unit on an associated watercraft, the bracket assembly including a swivel bracket carrying the drive unit for pivotal movement about a steering axis that extends generally vertically, the swivel bracket having a tubular section that extends generally vertically, the drive unit having a steering member that includes a steering shaft section, the steering shaft section extending through the tubular section of the swivel bracket and defining the steering axis, the steering shaft section having top and bottom portions that exposed beyond at least a portion of the tubular section, the top and bottom portions being attached to the drive unit, the steering shaft section further having an upper portion below the top portion within the tubular section, and a lower portion above the bottom portion within the tubular section, the tubular section including upper, lower and middle bushings, the upper bushing pivotally supporting the upper portion of the steering shaft section, the lower bushing pivotally supporting the lower portion of the steering shaft section, and the middle bushing pivotally supporting a middle portion of the steering shaft section between the upper and lower portions, wherein the tubular section of the swivel bracket and the steering shaft section of the steering member defines an upper space therebetween above the middle bushing, the tubular section of the swivel bracket and the steering shaft section of the steering member defines a lower space therebetween below the middle bushing, and at least the middle bushing defining a passage through which the upper and lower spaces communicates with each other, without any clutch disposed between the tubular section and the steering shaft and between the upper and lower bushings.

26. The outboard motor as set forth in claim 25, wherein the steering shaft section has an inner surface that tapers over approximately half of its length from the upper portion toward the middle portion, and over approximately half of its length from the lower portion toward the middle portion.

* * * * *